US008998443B1

(12) United States Patent
Shumate et al.

(10) Patent No.: US 8,998,443 B1
(45) Date of Patent: Apr. 7, 2015

(54) BEACON LIGHT HAVING A LENS

(71) Applicant: SPX Corporation, Charlotte, NC (US)

(72) Inventors: Christopher Shumate, Franklin, TN (US); Handani Kam, Franklin, TN (US); Nimrod McDade, IV, Franklin, TN (US); Russell Bruner, Franklin, TN (US); David Duryea, Franklin, TN (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 14/042,973

(22) Filed: Oct. 1, 2013

(51) Int. Cl.

| | |
|---|---|
| ***G08B 5/22*** | (2006.01) |
| ***F21K 99/00*** | (2010.01) |
| ***F21V 5/04*** | (2006.01) |
| *F21V 21/16* | (2006.01) |

(52) U.S. Cl.
CPC . *F21K 9/50* (2013.01); *F21V 5/045* (2013.01); *F21V 21/16* (2013.01)

(58) Field of Classification Search
CPC ..... F21V 21/16; F21S 8/04
USPC ..... 362/249.02, 235; 340/815.45
See application file for complete search history.

(56) References Cited

U.S. PATENT DOCUMENTS

| | | | | |
|---|---|---|---|---|
| 6,086,220 | A * | 7/2000 | Lash et al. | 362/244 |
| 6,483,439 | B1 * | 11/2002 | Vukosic | 340/815.65 |
| 6,525,668 | B1 * | 2/2003 | Petrick | 340/815.45 |
| 6,844,824 | B2 * | 1/2005 | Vukosic | 340/815.65 |
| 7,217,006 | B2 * | 5/2007 | Trenchard et al. | 362/249.02 |
| 7,252,405 | B2 * | 8/2007 | Trenchard et al. | 362/235 |
| 7,378,983 | B2 * | 5/2008 | Wang et al. | 340/815.45 |
| 7,534,009 | B2 * | 5/2009 | Trojanowski et al. | 362/234 |
| 2011/0058370 | A1 | 3/2011 | Datz et al. | |
| 2011/0121734 | A1 | 5/2011 | Pape | |

OTHER PUBLICATIONS

Notification of Transmittal of the International Search Report and the Written Opinion of the International Searching Authority, or the Declaration dated Dec. 23, 2014.

Red Cliplite Lens_Mounting Clip_AllElectronics Sep. 20, 2013, https://web.archive.org/web/2013092013491/http:www.allelectronics.com/make-a-store/item/HLDCL-R/RED-CLIPLITE-LENS/MOUNTING-CLIP/1.html. Downloaded Dec. 11, 2013.

* cited by examiner

*Primary Examiner* — Anabel Ton

(74) *Attorney, Agent, or Firm* — Baker & Hostetler LLP

(57) ABSTRACT

A beacon light and lens system includes a base, a light emitting diode assembly having at least one light emitting diode secured to the base, a lens including optics configured to capture and direct light from the at least one light emitting diode, a driver board configured to power the at least one light emitting diode, a power source connected to the driver board wherein the lens is mounted on the base. The system generates a 360° horizontal beam pattern and a predetermined vertical beam pattern.

20 Claims, 15 Drawing Sheets

BEACON LIGHT HAVING A LENS

BACKGROUND OF THE DISCLOSURE

1. Field of the Disclosure

This disclosure is directed to a device for directing light from light emitting diode sources, and, more particularly to a device for capturing and directing light from light emitting diode sources for beacon lights.

2. Related Art

Many beacon lights or obstruction lights are constructed utilizing incandescent bulbs. The incandescent bulb provides an even light distribution. However, because beacon lights are typically very bright, the incandescent bulbs have a tendency to have a shorter life. This is problematic when the beacon light is arranged at the top of a tall building or tower. Accordingly, maintenance personnel must climb to the top of the tower or building in order to replace the incandescent bulb.

Other beacon lights have been constructed using light emitting diodes. Light emitting diodes lights are beneficial in that they have a much longer life and do not typically need to be replaced as often as incandescent bulbs. However, the point source nature of light emitting diodes results in a light distribution which is overly bright or overly dim depending on the position in which the light is observed. More specifically, the beacon light must typically provide light across an essentially 360° range horizontally around the light. Similarly, the beacon light must provide a vertical spread of light having an even distribution. These requirements allow the beacon light to provide the obstruction warning they are designed for such as aircraft coming from any direction and flying at an altitude close to the beacon light itself. The prior art approaches have used mirrors to spread and distribute the light. However, the mirrors or other distribution approaches are complex and costly.

Accordingly, a beacon light is needed that provides the benefits of light emitting diodes and provides an even distribution of light in a cost-effective manner.

SUMMARY OF THE DISCLOSURE

According to an aspect of the disclosure, a beacon light and lens system is provided. The beacon light and lens system includes a base, a light emitting diode assembly, a lens and a driver board. The base is configured to attach the beacon light to a structure. The light emitting diode assembly includes at least one light emitting diode secured to the base. The lens has optics configured to capture and direct light horizontally from the light emitting diode. The lens is mounted on the base and has at least one mounting tab configured to mechanically fasten the lens to the base by cooperating with a slot arranged in the base. The driver board is configured to power the light emitting diode.

According to a further aspect of the disclosure, a beacon light and lens system is provided. The beacon light and lens system includes a base, a light emitting diode assembly, and a lens. The base is configured to attach the beacon light to a structure and includes at least one mounting tab configured to mechanically fasten the lens to the base by cooperating with a slot arranged in the base. The light emitting diode assembly includes at least one light emitting diode secured to the base. The lens has a Fresnel lens configuration and has optics configured to capture and direct light from the at least one light emitting diode.

Additional features, advantages, and embodiments of the disclosure may be set forth or apparent from consideration of the following detailed description, drawings, and claims. Moreover, it is to be understood that both the foregoing summary of the disclosure and the following detailed description are exemplary and intended to provide further explanation without limiting the scope of the disclosure as claimed.

BRIEF DESCRIPTION OF THE DRAWINGS

The accompanying drawings, which are included to provide a further understanding of the disclosure, are incorporated in and constitute a part of this specification, illustrate embodiments of the disclosure and together with the detailed description serve to explain the principles of the disclosure. No attempt is made to show structural details of the disclosure in more detail than may be necessary for a fundamental understanding of the disclosure and the various ways in which it may be practiced. In the drawings.

DETAILED DESCRIPTION OF THE DISCLOSURE

Figure 1A:
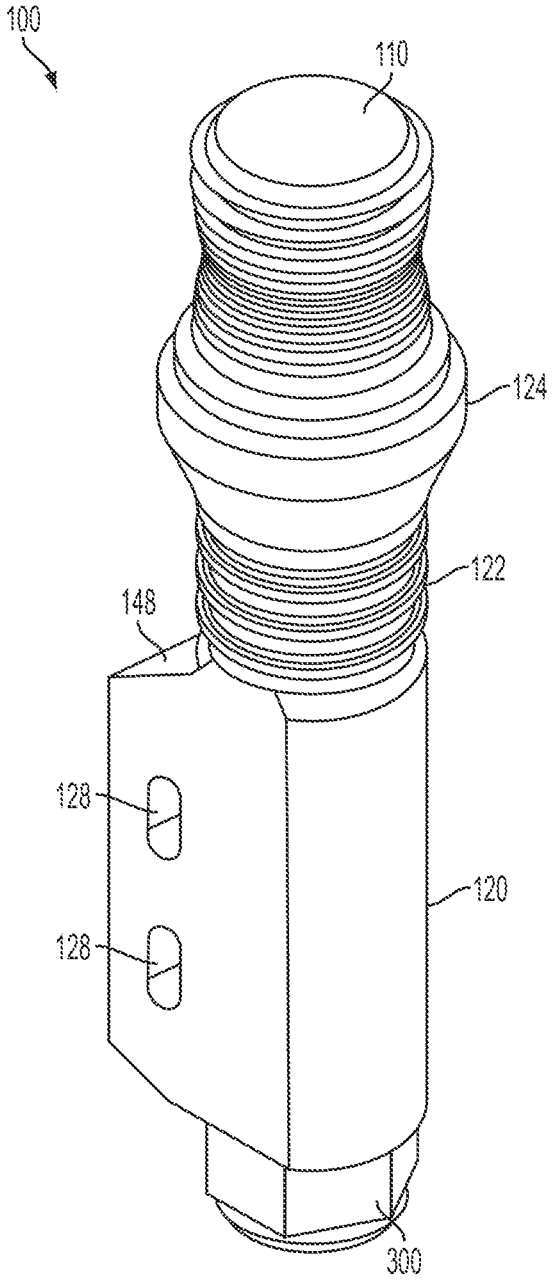
FIG. 1A shows a perspective view of a beacon light constructed in accordance with the principles of the invention.

The embodiments of the disclosure and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the disclosure. The examples used herein are intended merely to facilitate an understanding of ways in which the disclosure may be practiced and to further enable those of skill in the art to practice the embodiments of the disclosure. Accordingly, the examples and embodiments herein should not be construed as limiting the scope of the disclosure, which is defined solely by the appended claims and applicable law. Moreover, it is noted that like reference numerals represent similar parts throughout the several views of the drawings.

Figure 1B:
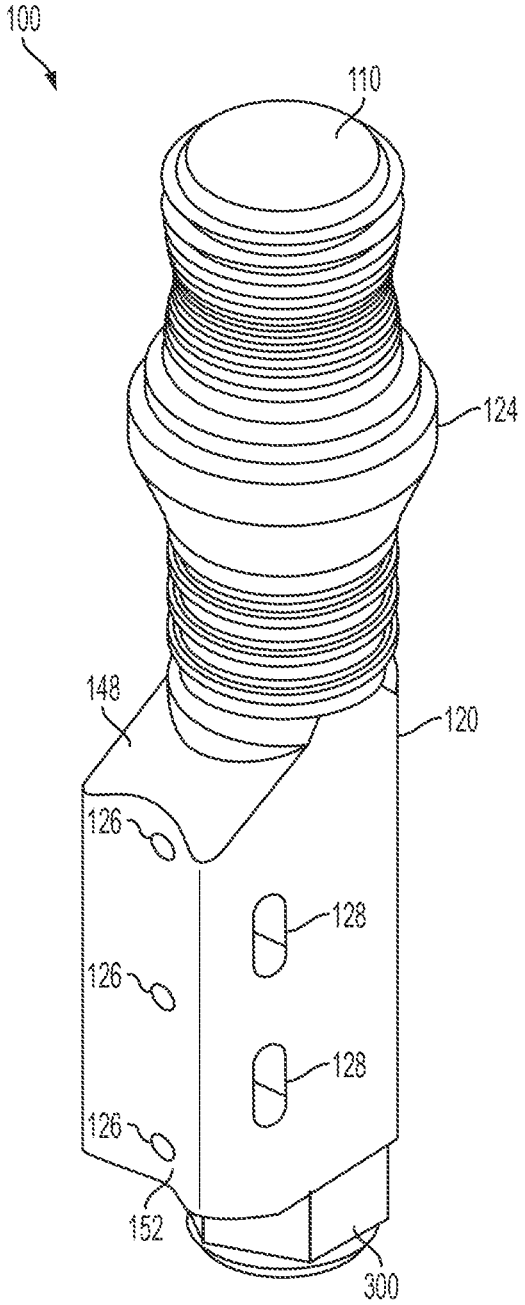
FIG. 1B shows another perspective view of the beacon light of FIG. 1A.
Figure 1C:
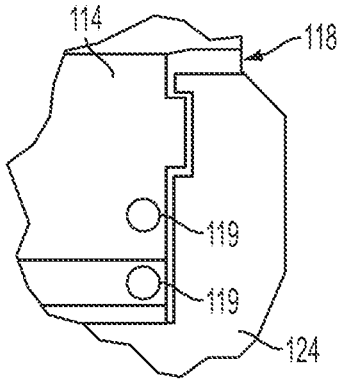
FIG. 1C shows a detailed partial view of the gasket and O-rings used in the beacon light of FIG. 1.
Figure 2:
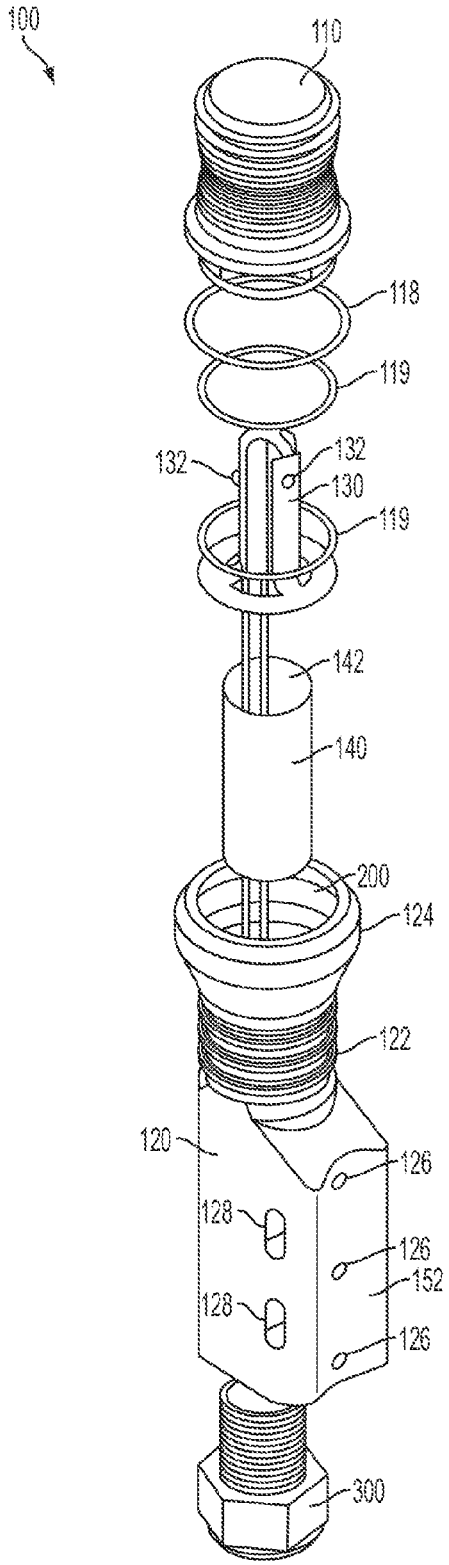
FIG. 2 shows an exploded view the beacon light of FIG. 1.
Figure 3:
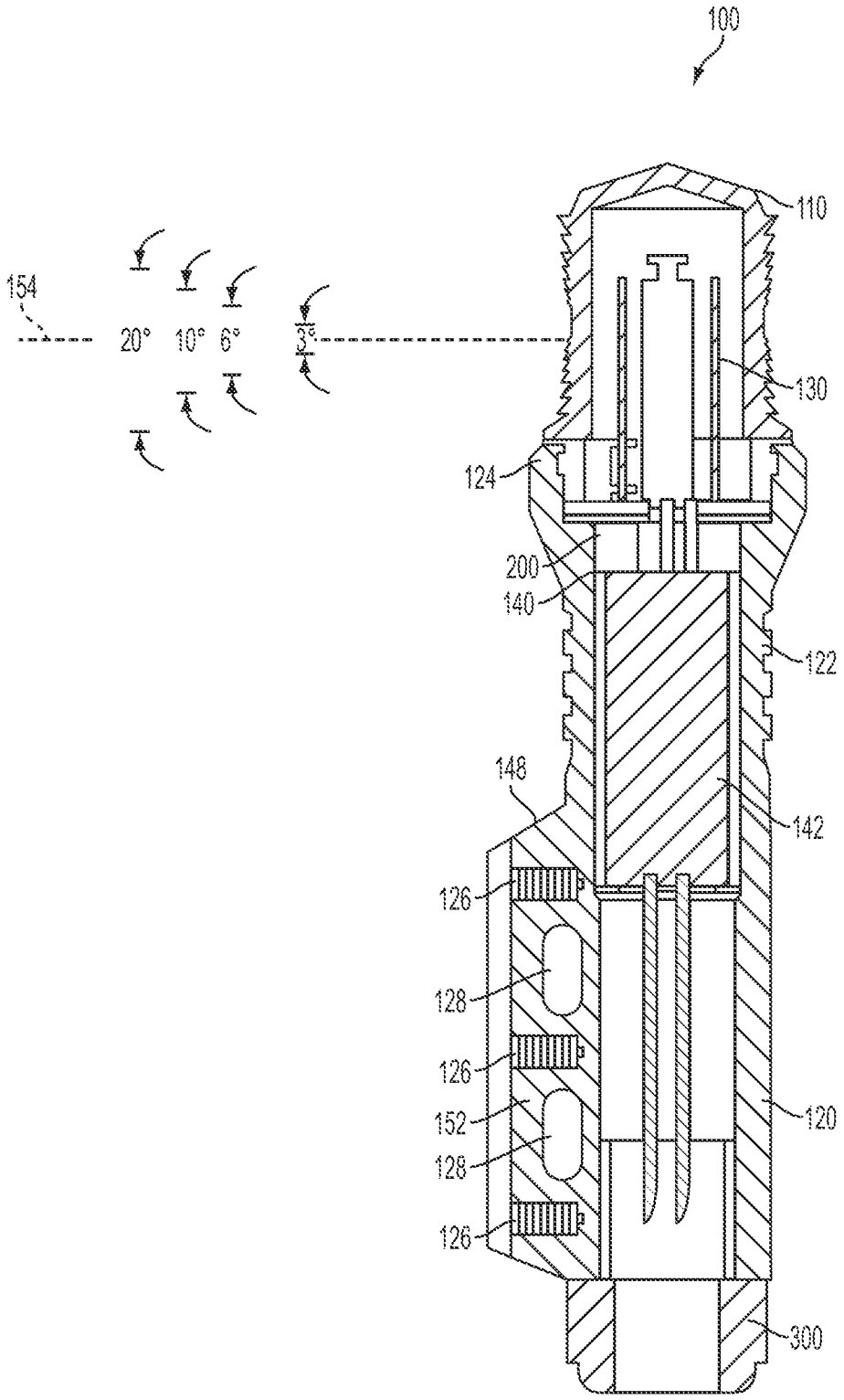
FIG. 3 shows a cross section view of the beacon light of FIG. 1.

FIG. 1A shows a perspective view of a beacon light constructed in accordance with the principles of the invention; FIG. 1B shows another perspective view of the beacon light of FIG. 1A; FIG. 1C shows a detailed partial view of the gasket and O-rings used in the beacon light of FIG. 1; FIG. 2 shows an exploded view the beacon light of FIG. 1; and FIG. 3 shows a cross section view of the beacon light of FIG. 1. In particular, FIGS. 1A and 1B show the beacon light 100 having a lens 110 and a base 120. The lens 110 is arranged on top of the base 120. In particular, the lens 110 may include optics for the beacon light 100 that are configured to capture and direct light from multiple light emitting diode sources into a 360° horizontal beam pattern and further configured to capture and direct light from the multiple light emitting diode sources into a predetermined vertical beam pattern. The optics provide a substantially even light distribution over the 360° horizontal beam pattern and a substantially even light distribution over the predetermined vertical beam pattern. As shown in FIG. 3, the predetermined vertical beam pattern may be configured to direct light along an optical axis 154 with a beam spread of less than 20° from the optical axis 154 of each one of the plurality of LEDs. In a particular aspect, the predetermined vertical beam pattern may be 10°. In a further particular aspect, the predetermined vertical beam pattern may be less than 6°. In yet a further aspect, the predetermined vertical beam pattern may be 3°. Moreover, the optics are configured to provide very little stray or wasted light outside of this predetermined vertical beam pattern. Of course other horizontal and vertical beam patterns are contemplated by the invention. Moreover, other types of light sources other than light emitting diode are further contemplated. Finally, the horizontal beam pattern may be configured to provide less than 360° if desired in the particular application. For example, if multiple lights are utilized, then less than 360° of horizontal beam may be desired or appropriate. A particular implementation of the optics may utilize a Fresnel lens configuration to provide the desired horizontal and vertical beam pattern.

The base 120 may be constructed of a metallic or other material to provide weather resistance or protection from the environment to the internal components of the beacon light 100. In a particular aspect, the base 120 may be cast metal material. Metals such as aluminum may be used to form the base 120. Of course other constructions are contemplated as well. Polymers and injection plastics such as ABS, polyethylene or other synthetic materials may be used. The base 120 may be cast as a single piece and/or machined. Additionally, three-dimensional printing is also contemplated for the manufacturing of the base 120 and may further include machining. The base 120 may be painted or coated for added environmental protection and for marking identification. The base 120 may be etched with markings and/or labeled.

The base 120 may also include a ring portion 122 that is configured to increase the surface area of the base 120 and provide heat dissipation generated by the internal components. The base 120 also includes a circular mating area 124 that is configured to receive the lens 110. The circular mating area 124 is indented such that the lens 110 may fit securely into the circular mating area 124 of the base 120. The lens 110 may be mounted over the LED assembly 130 as explained in detail below.

Figure 4A:
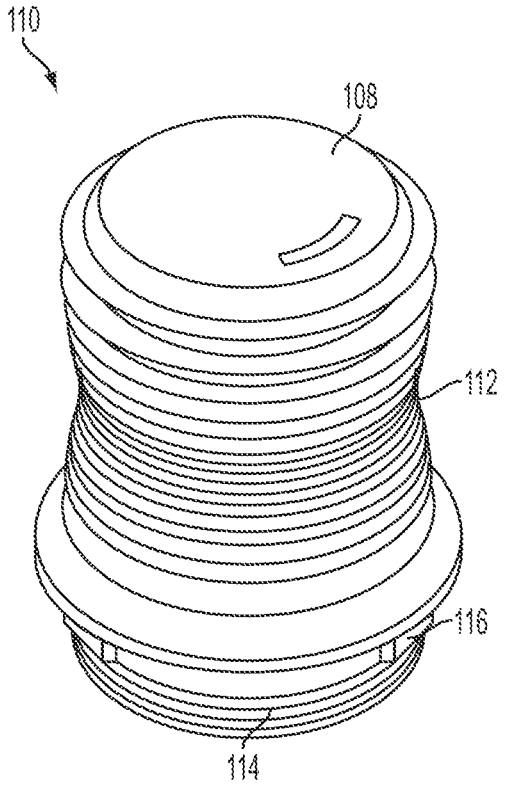
FIG. 4A shows a perspective view of the lens of the beacon light of FIG. 1.
Figure 4B:
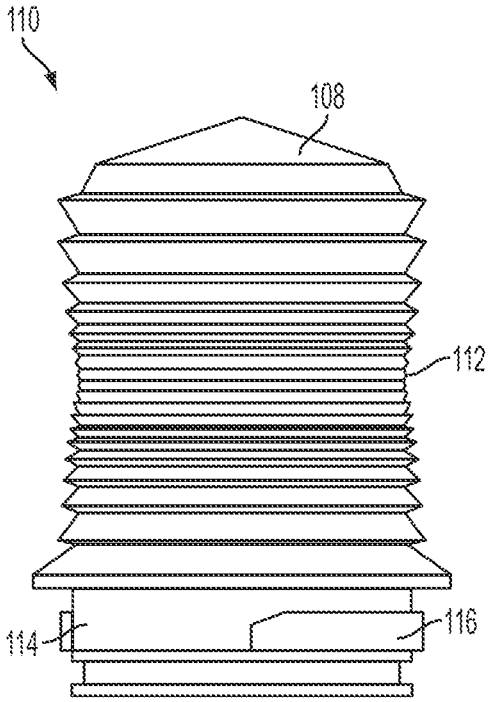
FIG. 4B shows a side view of the lens of the beacon light of FIG. 1.
Figure 4C:
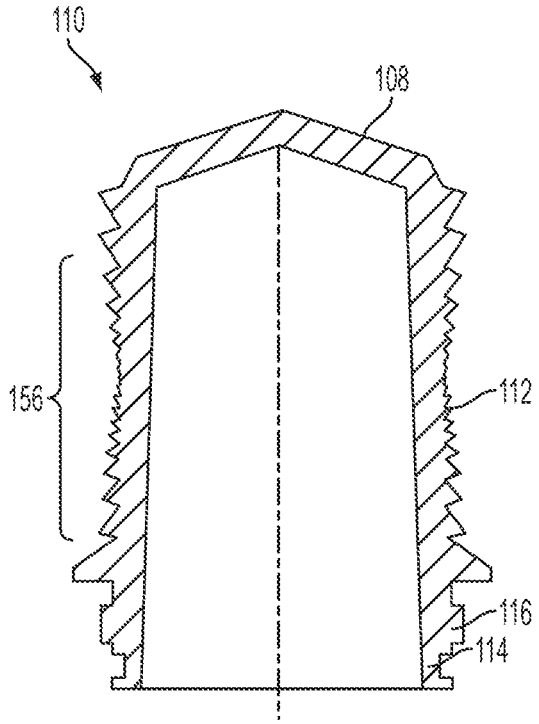
FIG. 4C shows a cross-section view of the lens of the beacon light of FIG. 1.

A detailed view of the lens 110 is shown in FIGS. 4A, 4B, and 4C. As shown, the lens 110 has a top portion 108 and a bottom portion 114. The outer surface 112 of top portion 108 of the lens may be convex. The convex shape of the outer surface 112 of the lens 110 ensures that light is directed from the LED assembly 130 with a limited loss of light. Moreover, the convex shape of the outer surface 112 together with the ridges 156 as shown in FIG. 4C provide the Fresnel optics described above. The bottom portion 114 of the lens 110 is configured to fit into the circular mating area 124 of the base 120.

FIGS. 4A, 4B, and 4C illustrate the lens 110 of the beacon light 100. The bottom portion 114 of the lens 110 may also include tabs 116 as shown in FIGS. 4A, 4B, and 4C. The tabs 116 may further assist the lens 110 to securely fit into the base 120. The tabs 116 mechanically fasten to a corresponding slot arranged in the circular mating area 124 of the base 120. The tabs 116 may be chamfered. This arrangement of the bottom portion 114 of the lens 110 may allow the lens 110 to twist and lock into the circular mating area 124 of the base 120. This arrangement may also allow the beacon light 100 to be easily assembled or disassembled as needed. Other types of mechanical fastening are contemplated as well.

The lens 110 may be formed from acrylic, glass or a plastic material. A single lens 110 may be used to form the beacon light 100 or multiple lenses may be used. The lens 110 may be cast as a single piece and/or machined. Additionally, three-dimensional printing is also contemplated for the manufacturing of the lens 110 and may further include machining.

FIG. 2 illustrates the beacon light of FIG. 1 in an exploded view. As shown in FIG. 2, the beacon light 100 includes an LED assembly 130 having a plurality of LEDs 132. The beacon light 100 also includes a potting assembly 140 and driver board 142. The driver board 142 may be a printed circuit board (PCB) used to regulate the current received from an external power source and distribute the current to the LED assembly 130. The driver board 142 may have an operating voltage between 12V DC to 48V DC. In some aspects, the driver board 142 may be polarity insensitive. A transient voltage suppressor may also be coupled to the driver board 142 to suppress undesired voltage. A rectifier may optionally be used with the driver board 142. In some embodiments, the rectifier is adapted to convert AC 120V into the desired DC operating voltage.

Figure 7A:
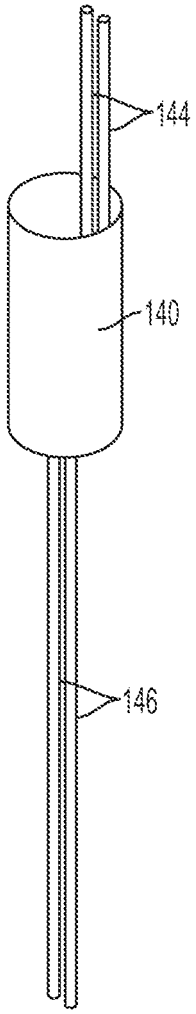
FIG. 7A shows a perspective view of an internal element of the beacon light of FIG. 1.
Figure 7B:
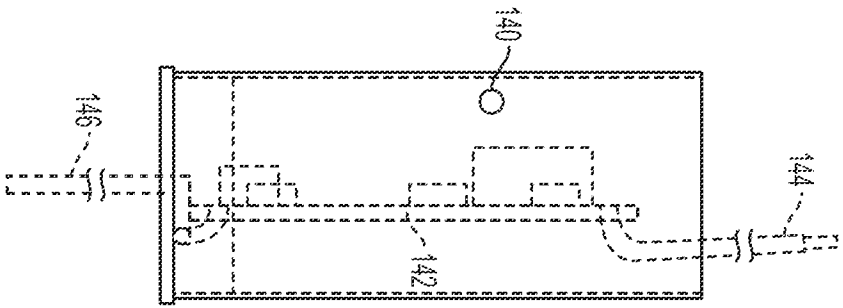
FIG. 7B shows a cross section view of an internal element of the beacon light of FIG. 1.

The potting assembly 140 and driver board 142 is shown in FIG. 3. A view of the potting assembly 140 is also shown in FIGS. 7A and 7B along with the associated lead wires 144, 146. The lead wires 144 extend from the driver board 142 through the top of the potting assembly 140 and connect the driver board 142 to the light emitting diode PCB 136. The lead wires 146 extend from the driver board 142 through the bottom of the potting assembly 140 and connect the driver board 142 to an external power source (not shown).

The potting assembly 140 may be formed to encapsulate the driver board 142 and protect it from moisture and any mechanical damage. Furthermore, the potting assembly 140 provides heat dispersion. As shown in FIG. 2, the potting assembly 140 is configured to fit within the ring portion 122 of the base 120. The LED assembly 130 is mounted onto or above the potting assembly 140 and connected to the driver board 142 by the lead wires 144.

The potting assembly 140 may be rigid or soft. The potting assembly 140 may be potted within a cylindrical plastic tube which is open at each end and which is formed using insulating, plastic material such as PVC. The tube has slots to accommodate external wiring 144, 146. Alternatively, the potting assembly 140 may be formed without a housing. For example, the potting assembly 140 may be formed using a potting mold. The driver board 142 is placed into the potting mold and a potting compound such as a polymeric resin is poured into the mold such that all the electronic components are covered. The potting compound may then be cured such that the driver board 142 is formed as integral part of the potting assembly 140.

A gasket 118 may be used to further seal the connection between the lens 110 and the base 120 and protect the internal components of the beacon light 100 from the environment. As shown in FIG. 2, the gasket 118 may be arranged at the contact between the bottom portion 114 of the lens 110 and the circular mating area 124 of the base 120. Similarly, O-rings 119 may be arranged between the LED assembly 130 and the bottom portion 114 of the lens 110 for the same purpose. FIG. 1C illustrates a cross-sectional view of the specific arrangement of the gasket 118 and O-rings 119 that may be used to assemble the components of the beacon light 100 together. In particular, one O-ring 119 may be arranged horizontally to the side of the lens 110 and in particular the bottom portion 114 of the lens 110. Another O-ring 119 may be arranged below the lens 110 and below the bottom portion 114 of the lens 110.

The base 120 may be attached to a tower, tall building, or like structure. In order to provide the attachment to such a structure, the base 120 may include a mounting structure either inside the base 120 or external to the base 120. The base may also include slots 128 such that tie straps may be used to fasten the beacon light 100 to a structure. Other types of mechanical fastening of the base 120 to a structure are contemplated as well. For example, metal clamps may be used. There may also be one or more threaded holes 126 positioned vertically along the base 120 such that beacon light 100 may be secured to a structure using bolts and/or screws.

Additionally, a surface 152 of the beacon light 100 may be curved in order for the beacon light 100 to mate with a cylindrical shaped structure. Finally, the base 120 may include an offset portion that includes the slots 128 to offset the beacon light 100 from the structure to which it attaches.

The lens 110 may be mounted on the base 120. The base 120 may include various electrical connections to the beacon light 100. In particular, within the base 120 may be located a space 200 (shown in FIG. 2) to allow installers or maintenance personnel to connect, test, repair, and so on electrical and data lines connected to the beacon light 100. This space 200 provides weather and environmental protection to these lines and their associated connections (not shown).

The base may further include a strain relief 300. The strain relief 300 may be configured to receive the electrical and/or data lines or a conduit containing the same. The construction of the strain relief 300 may limit intrusion of water or other environmental contaminants to the beacon light 100, conduit, or the like. Additionally, the beacon light 100 may include other features to limit intrusion of water including an inclined surface 148 that helps guide rainwater and the like away from the beacon light 100.

Figure 5A:
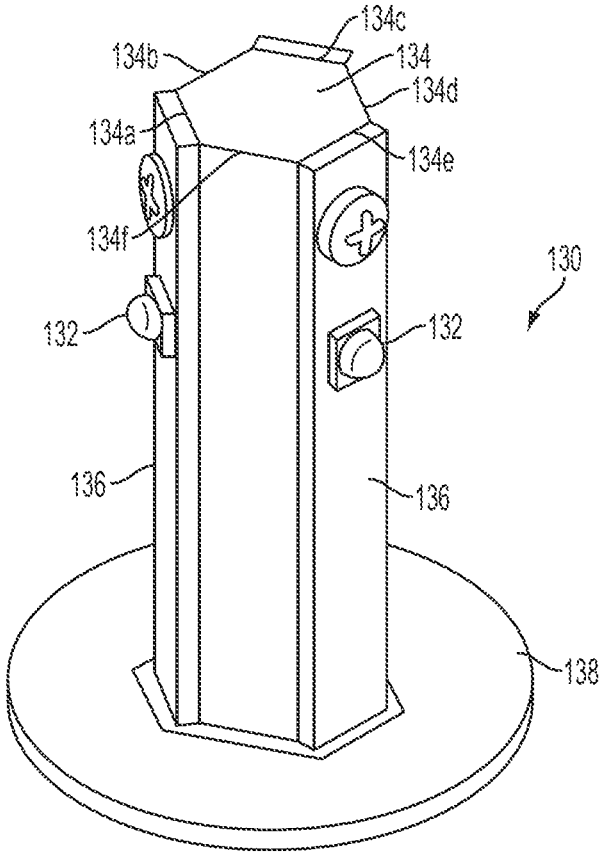
FIG. 5A shows a perspective view of a portion of the light emitting diode assembly of the beacon light of FIG. 1 according to one aspect.
Figure 5B:
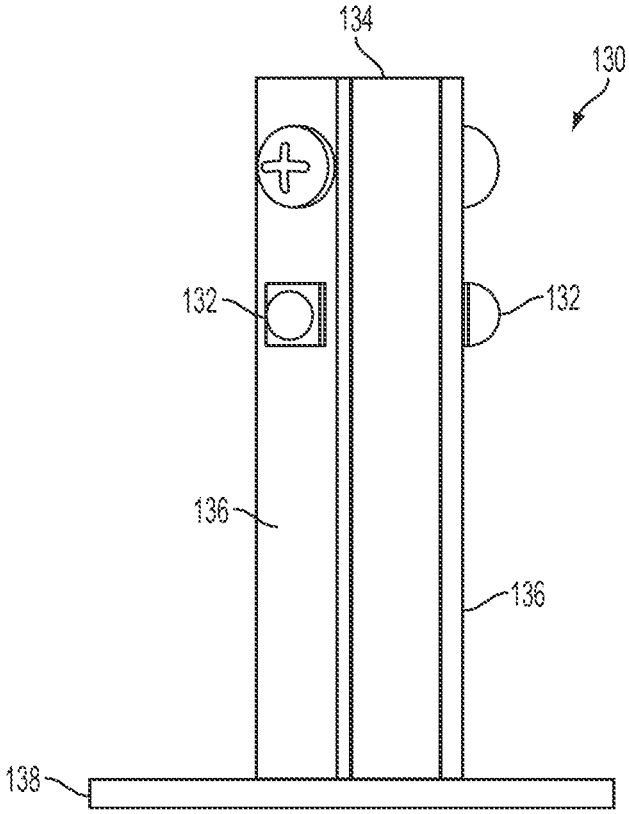
FIG. 5B shows a side view of a portion of the light emitting diode assembly of the beacon light of FIG. 5A.

FIGS. 5A and 5B illustrate a specific construction of the LED assembly 130. As shown, the LED assembly 130 may include a plurality of individual light emitting diodes 132, a core 134, light emitting diode PCBs 136 and a motherboard 138. The LED assembly 130 shown in FIGS. 5A and 5B is polygonal in shape. Other geometries, however, may be used. The core 134 has six adjacent planar faces 134*a*, 134*b*, 134*c*, 134*d*, 134*e* and 134*f*. Light emitting diode PCBs 136 are arranged on the alternating adjacent planar faces 134*a*, 134*c* and 134*e* of the core 134. There is a total of three light emitting diode PCBs 136 in the LED assembly shown in FIGS. 5A and 5B. However, any number of light emitting diode PCBs 136 may be arranged to form the LED assembly 130. The light emitting diode PCBs 136 are fastened to the core 134 by screws or any other mechanical fasteners that may be used to secure the light emitting diode PCBs 136 to the core 134. Additionally, an adhesive may additionally or alternatively be used to secure each light emitting diode PCB 136 to the core 134.

Individual LEDs 132 may be arranged on each light emitting diode PCB 136. The motherboard 138 is mounted onto the core 134. The core 134 serves to mechanically support the light emitting diode PCBs 136 and also acts as a heat sink. This is useful because the light emitting diode PCBs 136 may generate a significant amount of heat and the heat may need to dissipate. The core may be constructed of a metallic material to ensure that there is adequate heat transfer. In this implementation, the individual LEDs 132 are connected in series.

FIGS. 5A and 5B further show the core 134 that may be arranged on the motherboard 138. As shown, the core 134 may include a motherboard 138 with the light emitting diode PCB 136. Both the motherboard 138 and the light emitting diode PCBs 136 receive power and/or data to drive the light emitting diodes 132 associated with the core 134. The data and/or power lines may extend through the space 200 shown in FIG. 2, and may extend up through a cord connector 300. Subsequently, data and/or power lines may connect to the mother board 138 and/or the light emitting diode PCB 136.

The mother board 138 and/or the light emitting diode PCB 136 may include one or more sensors. In particular, the mother board 138 and/or the light emitting diode PCB 136 may include a temperature sensor to sense a temperature and control operation based on the temperature. The mother board 138 and/or the light emitting diode PCB 136 may include a light sensor to sense the amount of light output by the beacon light 100 and/or sense the ambient light and control operation based on the light sensed.

In particular, FIGS. 5A and 5B show the core 134 having a plurality of light emitting diode PCBs 136. In the implementation shown in FIGS. 5A and 5B, there are three light emitting diode PCBs 136. Of course, any number of boards 136 is contemplated by the invention. In particular, the invention may be implemented with a single light emitting diode PCB board 136.

Figure 6A:
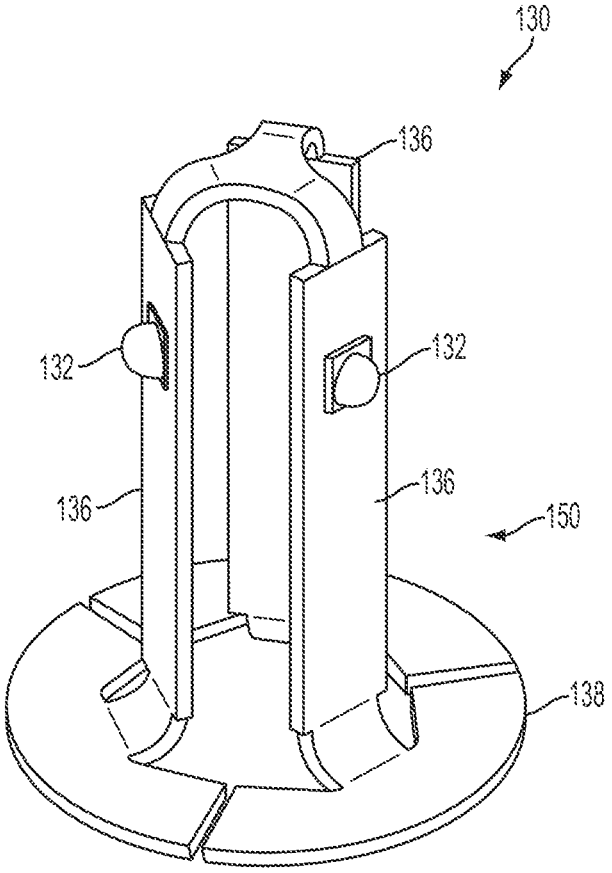
FIG. 6A shows a perspective view of a portion of the light emitting diode assembly of the beacon light of FIG. 1 according to another aspect.
Figure 6B:
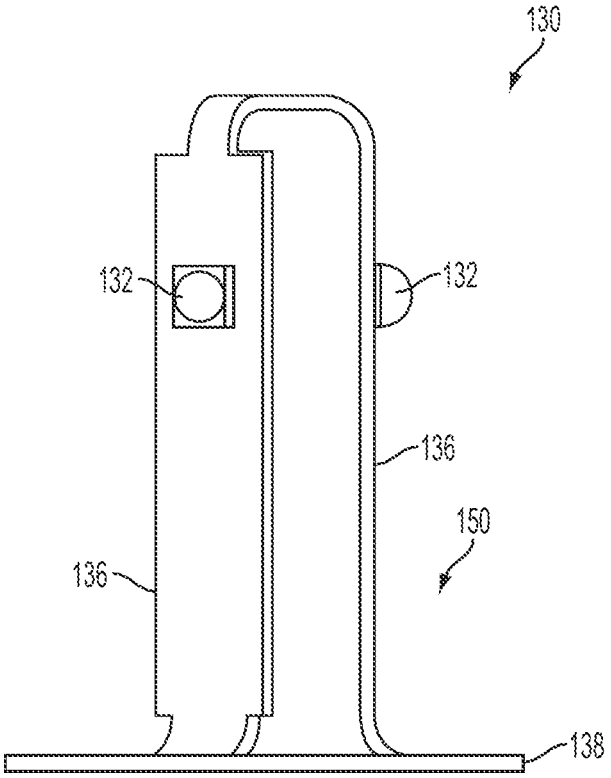
FIG. 6B shows a side view of a portion of the light emitting diode assembly of the beacon light of FIG. 6B.

FIG. 6A shows a perspective view of a portion of the light emitting diode assembly of the beacon light of FIG. 1 according to another aspect; and FIG. 6B shows a side view of a portion of the light emitting diode assembly of the beacon light of FIG. 6B. In particular, the invention may be implemented with a single flexible light emitting diode PCB 150. FIGS. 6A and 6B illustrate a flexible light emitting diode PCB 150 that includes at least one light emitting diode 132. The flexible light emitting diode PCB 150 may be mounted onto the potting assembly 140. The flexible light emitting diode PCB 150 may also configured to be used with or without a core 134, if desired.

Each of the light emitting diode PCBs 136 may have at least one light emitting diode 132. There may be white light emitting diodes 132 and/or red light emitting diodes 132. The white light emitting diode 132 may be operated during certain hours of the day; and the red light emitting diode 132 being operated during certain other hours of the day. Alternatively, the beacon light 100 may operate with only white light emitting diodes 132; or the beacon light may operate with only red light emitting diodes 132. Furthermore, the lens 110 may be tinted to achieve a desired emission color. A white light emission diode 132 may be used with a red tinted lens 110 to achieve emission of a red light. Additionally, the beacon light 100 may operate with one or more infrared light emitting diodes 132 to allow for visibility utilizing night vision goggles.

Figure 8:
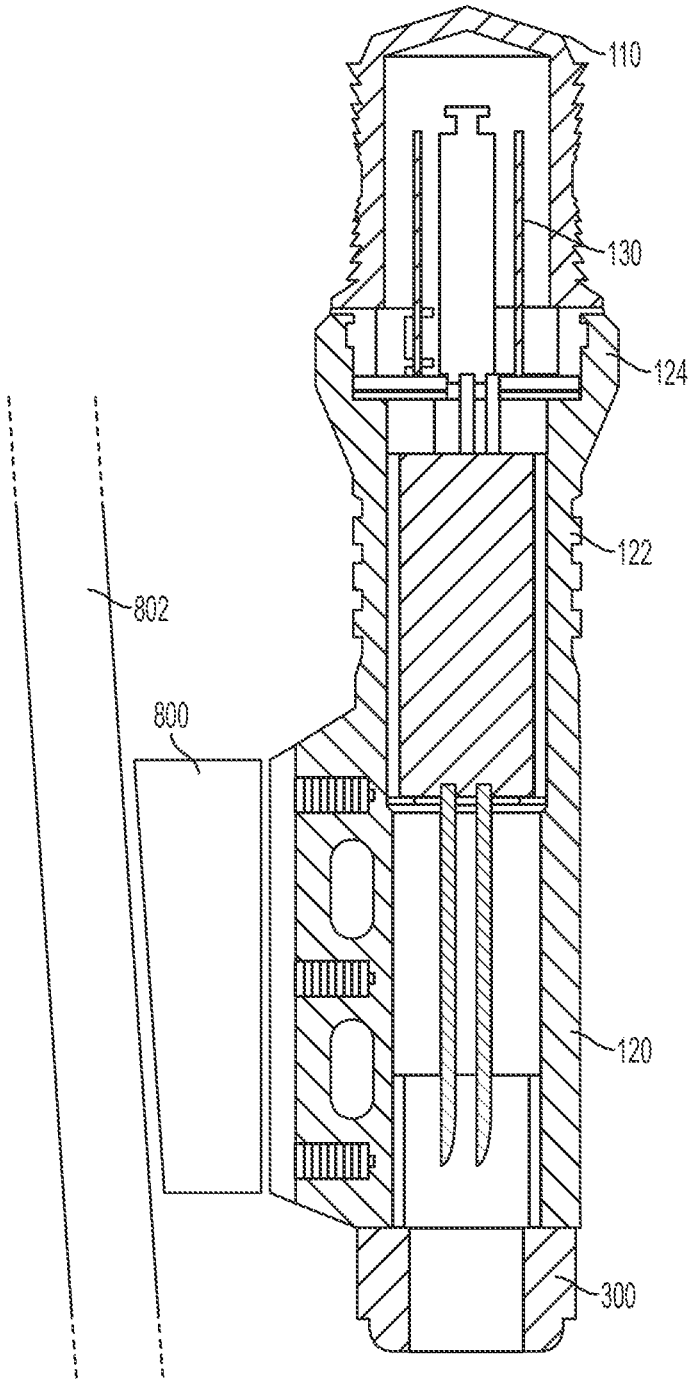
FIG. 8 shows a cross section view of the beacon light of FIG. 1 that includes a bracket.

FIG. 8 shows a cross section view of the beacon light of FIG. 1 that includes a bracket. A bracket 800 may also be used to arrange the beacon light 100 vertically when the structure 802 has an inclined surface. A bracket 800 or other mechanical device may be needed to offset the inclination of the structure and to ensure that the light is placed in a proper vertical position. In this regard, the beacon light 100 may connect to the bracket 800 as described above. The bracket 800 may further include its own slots, threaded holes, or the like to connect to the structure 802. Alternatively, the beacon like 100 may connect to the structure 802 through the bracket 800. Bracket 800 may be substituted by adjustable screw or similar mechanical device.

Accordingly, the beacon light constructed in accordance with the principles of the invention includes optics for the beacon light that are configured to capture and direct light from multiple light emitting diode sources into a 360° horizontal beam pattern and further configured to capture and direct light from the multiple light emitting diode sources into approximately 3° vertical beam pattern. The optics provide a substantially even light distribution over the 360° horizontal beam pattern and substantially even light distribution over the 3° vertical beam pattern.

While the disclosure has been described in terms of exemplary embodiments, those skilled in the art will recognize that the disclosure can be practiced with modifications in the spirit and scope of the appended claims.

These examples given above are merely illustrative and are not meant to be an exhaustive list of all possible designs, embodiments, applications or modifications of the disclosure.

What is claimed is:

1. A beacon light and lens system comprising:
a base configured to attach the beacon light to a structure;
a light emitting diode assembly comprising at least one light emitting diode secured to the base;
a lens comprising optics configured to capture and direct light horizontally from the at least one light emitting diode; and
a driver board configured to power the at least one light emitting diode,
wherein the lens is mounted on the base and comprises at least one mounting tab configured to mechanically fasten the lens to the base by cooperating with a slot arranged in the base, and
wherein the base comprises a curved mounting surface configured to mate to a cylindrical shaped structure.

2. A beacon light according to claim 1, wherein the lens comprises a Fresnel lens configuration having a convex shaped outer surface.

3. A beacon light according to claim 1, wherein the light emitting diode assembly comprises a motherboard and at least one light emitting diode PCB connected to the motherboard.

4. The lens system according to claim 1, wherein the system generates a 360° horizontal beam pattern and vertical beam pattern with a minimum of 10°.

5. A beacon light according to claim 1, wherein the base comprises an attachment structure comprising at least one slot configured to receive a fastener to fasten the base to a structure.

6. A beacon light according to claim 1, further comprising at least one O-ring arranged between the lens and the base.

7. A beacon light according to claim 1, further comprising at least one gasket arranged between the lens and the base.

8. The beacon light according to claim 1, wherein the at least one light emitting diode comprises at least one infrared light emitting diode, a white light emitting diode, and a red light emitting diode.

9. A beacon light and lens system comprising:
a base configured to attach the beacon light to a structure;
a light emitting diode assembly comprising at least one light emitting diode secured to the base; and
a lens comprising optics configured to capture and direct light from the at least one light emitting diode,
wherein the lens comprises a Fresnel lens configuration; and
wherein the lens is mounted on the base and comprises at least one mounting tab configured to mechanically fasten the lens to the base by cooperating with a slot arranged in the base, and
wherein the base comprises a curved mounting surface configured to mate to a cylindrical shaped structure.

10. A beacon light according to claim 9, wherein the light emitting diode assembly comprises a motherboard and at least one light emitting diode PCB connected to the motherboard.

11. The lens system according to claim 9, wherein the system generates a 360° horizontal beam pattern and vertical beam pattern with a minimum of 10°.

12. A beacon light according to claim 9, wherein the base comprises an attachment structure comprising at least one slot configured to receive a fastener to fasten the base to a structure.

13. A beacon light according to claim 9, further comprising at least one O-ring arranged between the lens and the base.

14. The beacon light according to claim 9, wherein the at least one light emitting diode comprises at least one infrared light emitting diode, a white light emitting diode, and a red light emitting diode.

15. A beacon light according to claim 1, further comprising a bracket configured to connect to the curved mounting surface and the cylindrical shaped structure when the cylindrical shaped structure is inclined with respect to the vertical.

16. A beacon light according to claim 9, further comprising a bracket configured to connect to the curved mounting surface and the cylindrical shaped structure when the cylindrical shaped structure is inclined with respect to the vertical.

17. A beacon light according to claim 1, wherein the base comprises an attachment structure comprising at least one threaded hole configured to receive a fastener to fasten the base to a structure.

18. A beacon light according to claim 9, wherein the base comprises an attachment structure comprising at least one threaded hole configured to receive a fastener to fasten the base to a structure.

19. A beacon light and lens system comprising:
a base configured to attach the beacon light to a structure;
a light emitting diode assembly comprising at least one light emitting diode secured to the base;
a lens comprising optics configured to capture and direct light horizontally from the at least one light emitting diode; and
a driver board configured to power the at least one light emitting diode,
wherein the lens is configured to mechanically fasten to the base, and
wherein the base comprises a curved mounting surface arranged along a vertical side of the base, the curved mounting surface configured to mate to a curved surface of a cylindrical shaped structure.

20. A beacon light according to claim 1, wherein the lens comprises a Fresnel lens configuration having a convex shaped outer surface.

* * * * *